US006912752B2

(12) United States Patent
Ferrari

(10) Patent No.: US 6,912,752 B2
(45) Date of Patent: Jul. 5, 2005

(54) SHOE-CLEANING MACHINE IN PARTICULAR FOR REMOVING MUD, SNOW AND DIRT FROM THE SOLES

(76) Inventor: Luciano Ferrari, Via dei Cappuccini, I-04100 Latina (IT)

( * ) Notice: Subject to any disclaimer, the term of this patent is extended or adjusted under 35 U.S.C. 154(b) by 245 days.

(21) Appl. No.: 10/239,401

(22) PCT Filed: Mar. 29, 2001

(86) PCT No.: PCT/IT01/00161

§ 371 (c)(1),
(2), (4) Date: Sep. 23, 2002

(87) PCT Pub. No.: WO01/74227

PCT Pub. Date: Oct. 11, 2001

(65) Prior Publication Data

US 2003/0051300 A1 Mar. 20, 2003

(30) Foreign Application Priority Data

Mar. 31, 2000 (IT) ..... RM20000063 U

(51) Int. Cl.[7] ..... A47L 23/02; A47L 23/20
(52) U.S. Cl. ..... 15/36; 15/310
(58) Field of Search ..... 15/36, 308, 311, 15/310

(56) References Cited

U.S. PATENT DOCUMENTS 3,737,942 A 6/1973 Casey
3,787,918 A 1/1974 Ebert
3,831,217 A 8/1974 Odawara
4,432,112 A * 2/1984 Muller et al. ..... 15/36
4,435,964 A * 3/1984 Misawa ..... 68/19.2
5,025,528 A 6/1991 Burey et al.
6,067,688 A * 5/2000 West ..... 15/311

FOREIGN PATENT DOCUMENTS

DE 44 08 079 C1 6/1995
FR 2 535 193 A1 5/1984

OTHER PUBLICATIONS

Patent Abstracts of Japan, vol. 1995, No. 02, Mar. 31, 1995 and JP 06 311960 (Fujita Corp.); Nov. 8, 1994.

* cited by examiner

*Primary Examiner*—Randall Chin
(74) *Attorney, Agent, or Firm*—Breiner & Breiner, L.L.C.

(57) ABSTRACT

This invention relates to an automatic machine for cleaning and brushing shoes and, in particular, ski boots, after ski boots, boots, etc., which specifically cleans the soles of the shoes too, removing any snow, mud, dirt, sand and the like with specific means, such as brushes and jets of (warm or cold) air and jets of a disinfectant liquid, the dirt, etc. being collected inside a specific container, and which machine may also sanitize the shoes and, in particular, the soles of the shoes.

16 Claims, 6 Drawing Sheets

SHOE-CLEANING MACHINE IN PARTICULAR FOR REMOVING MUD, SNOW AND DIRT FROM THE SOLES

TECHNICAL FIELD

This invention relates to a machine for removing from the soles of shoes any type of dirt, from snow to mud and ice, also sanitizing the soles, melting the snow or ice, or drying the shoes with hot air, if necessary.

BACKGROUND OF ART

It is a well-known fact that, in certain weather conditions, shoes may become rather dirty and that snow, mud, dirt and the like may stick to them and, in particular, to the soles; by way of example, suffice it to mention ski boots, to which large amounts of snow may stick and which subsequently melts in heated environments, such as a bar, shop, home, hotel, bus, etc., transforming the floor into a dirty and slippery mess; or the mud which tends to stick to one's shoes when walking in a construction site, field, riding-ground, cross-country motorcycling course, etc. It is proven that, in the above-mentioned cases, due to both the scarse aptitude of the persons concerned to wipe their shoes adequately on the doormat, and to the fact that the latter are not of much use anyway. Traditional means are absolutely inadequate and insufficient, whereby floors tend to be perpetually dirty, slippery and, therefore, may become dangerous, without mentioning that they deteriorate rapidly, with a large economic loss.

It is equally well-known that a number of shoe-cleaning devices have been invented, for both homes and public premises; these generally consist of a case containing a suitably poweful motor which, by means of appropriate couplings, drives brushes of a certain hardness and colour, in between which the user must place his shoe, preferably without taking it off; these brushes clean the upper part of the shoe, restoring their original shine.

These machines, however, as mentioned above, clean only the upper part of the shoe, leaving the soles in the same condition they were in.

DISCLOSURE OF INVENTION

According to the present invention there is provided an automatic machine for brushing shoes and, in particular, ski boots, after ski boots and other footwear, which, besides cleaning the upper also removes any snow, mud, dirt, sand, etc., from the sole too, which is collected inside a container by suitable means.

The machine comprises a small case, made of an unbreakable plastic material, such as, for example, ABS, PP, PET and the like, on the top of which are the necessary operating controls.

The brushes for cleaning the soles, preferably made of nylon or other fibres, are housed in the bottom section of the casing; the brushes are of the most suitable type and are placed inside a metal structure, with which are made integral the supports and relative ball bearings, the brush driving mechanism, the motor and any other mechanism required to operate the machine work.

In the top part of the metal structure may be fastened (in such a manner as to allow their rotation) two or more cup or roller brushes for cleaning the upper.

The brushes are activated by an electric motor of sufficient power, but other known kinds of motors may also be used.

Beneath the brushes there is a container for collecting the water and dirt resulting the cleaning operation; the container is provided with sensors that signal when it is necessary to empty the container, by means of a warning light and/or audible warning device, blocking the operation of the brushes, if necessary, until the container has been emptied and replaced.

The machine may be completed by means for sanitizing the soles, such as a container for disinfectant, pumps and nozzles for spraying the product, and other means, such as warm air ducts and the like for melting the ice or snow on the soles.

A loudspeaker and display may also be mounted on the machine and connected to corresponding sensors, so as to be able to play prerecorded vocal messages or visual displays guiding the user during the use of the machine.

To further improve the safety of the present shoe brushing and sanitization machine, sensors may be installed for determining the size of the shoe, such as to stop it from working if the shoes are either too small or too large.

A specific embodiment of the invention will now be described by way of example, with reference to the accompanying drawings, in which.

Figure 1:
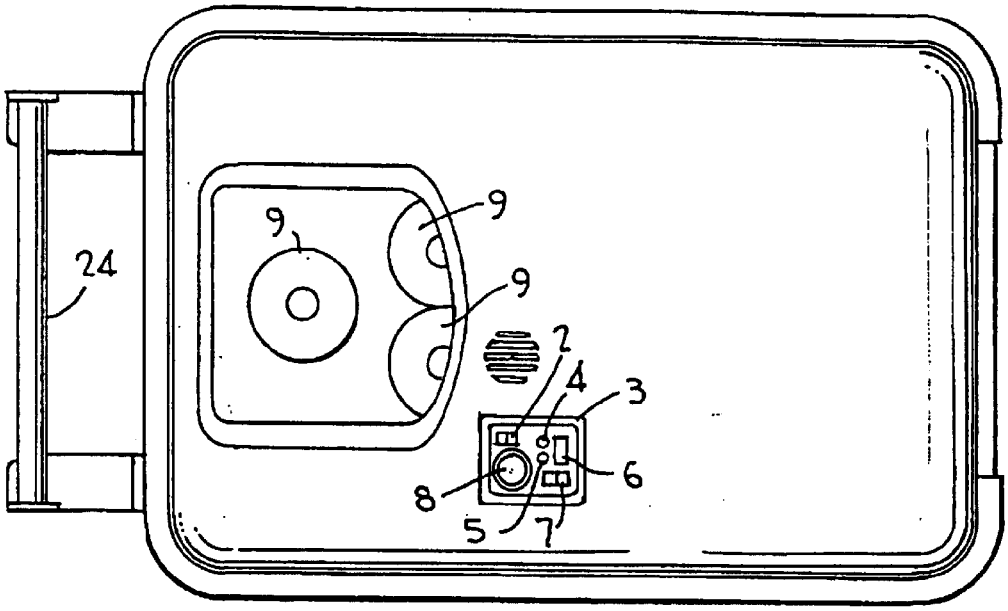
FIG. 1 shows a plan of the machine.
Figure 2:
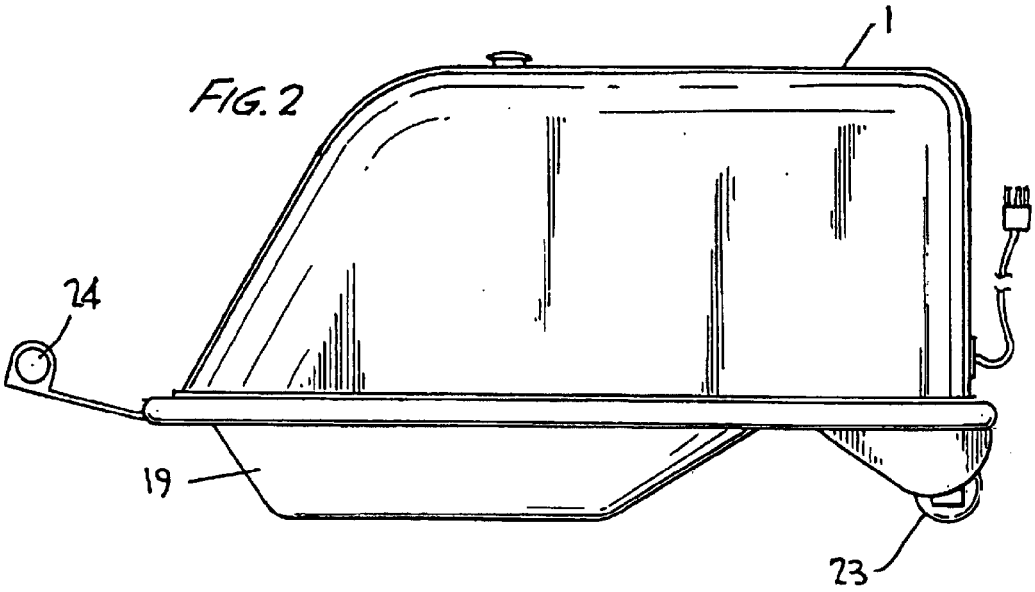
FIG. 2 shows a side view.
Figure 3:
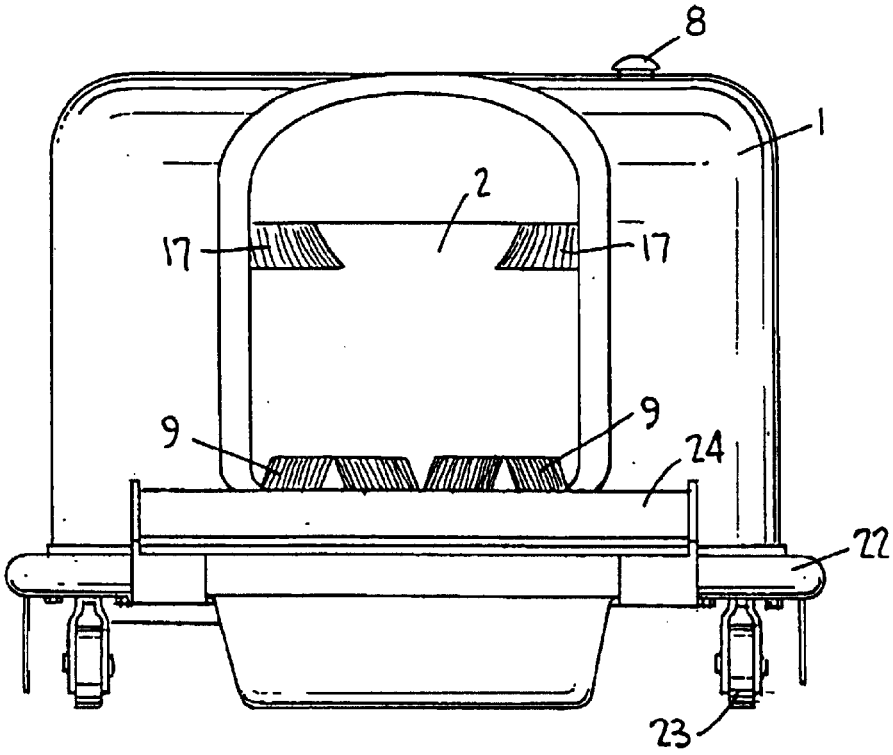
FIG. 3 shows a front view.
Figure 4:
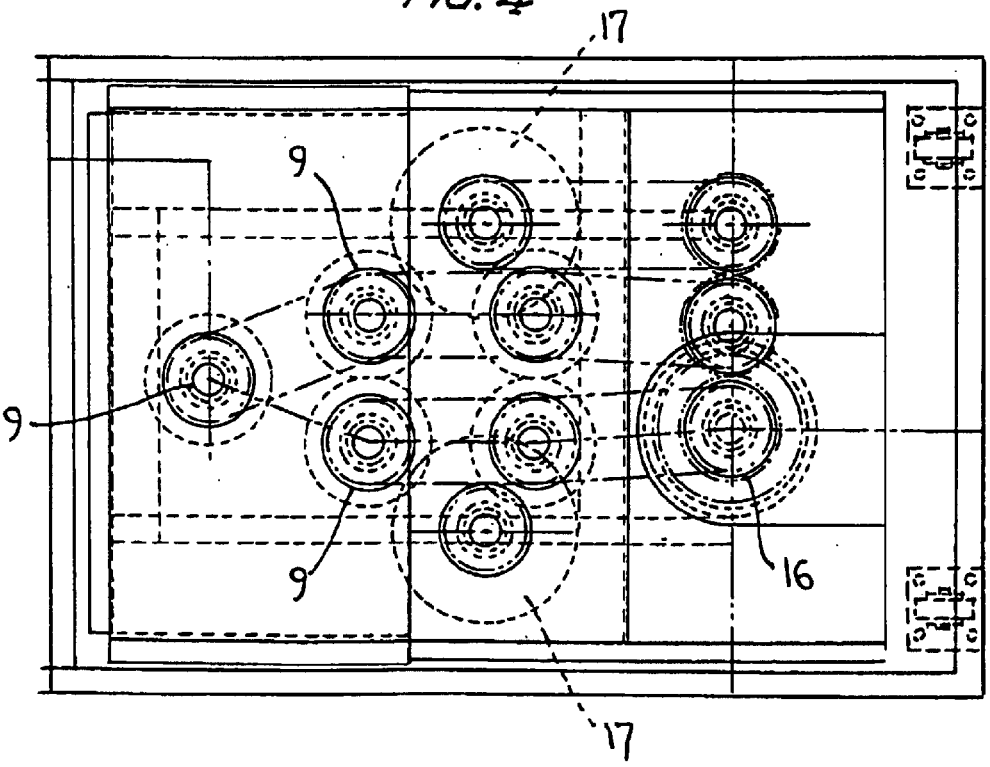
FIG. 4 shows a view from the top.
Figure 5:
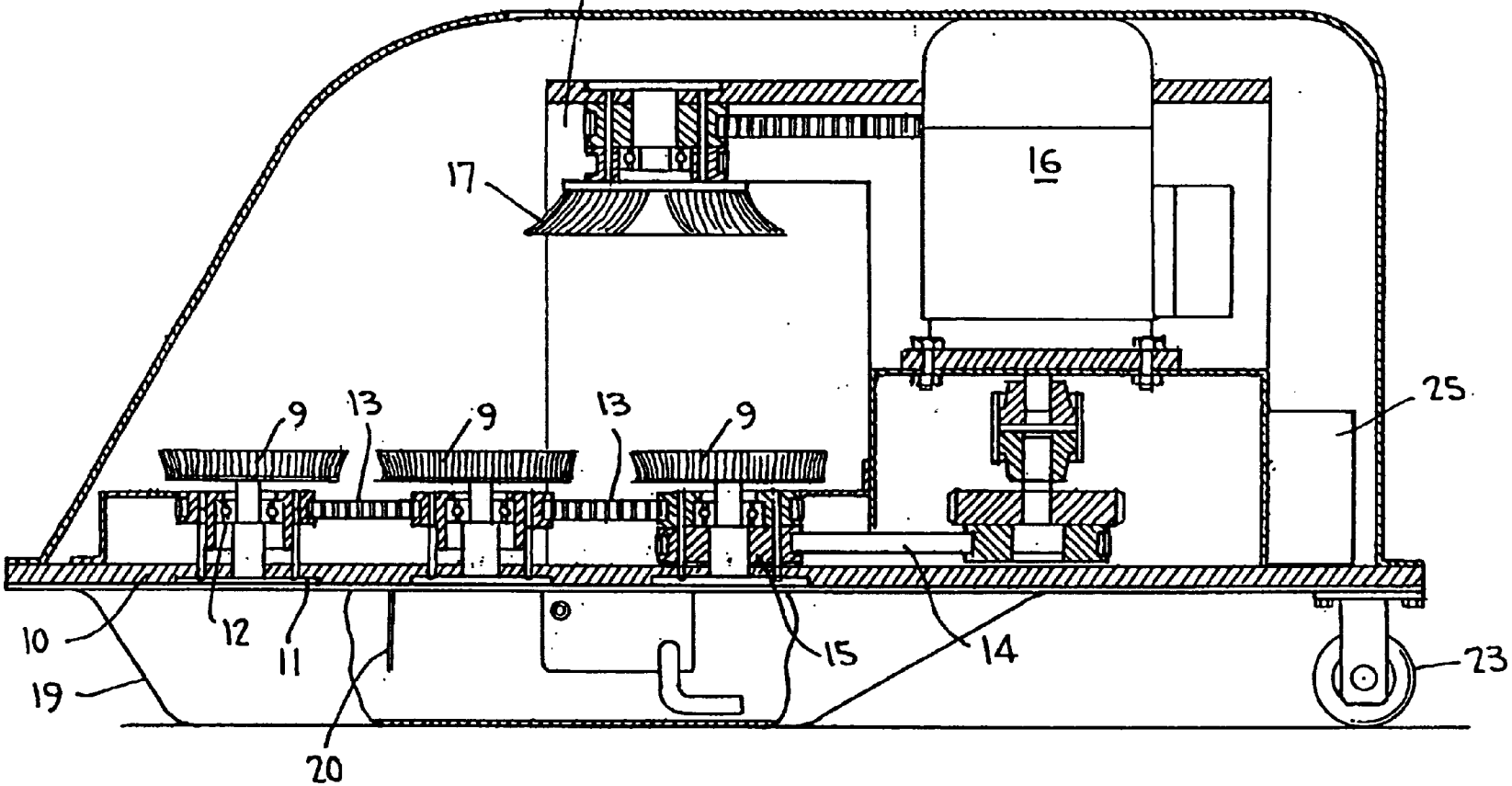
FIG. 5 shows a cross-section A—A.
Figure 6:
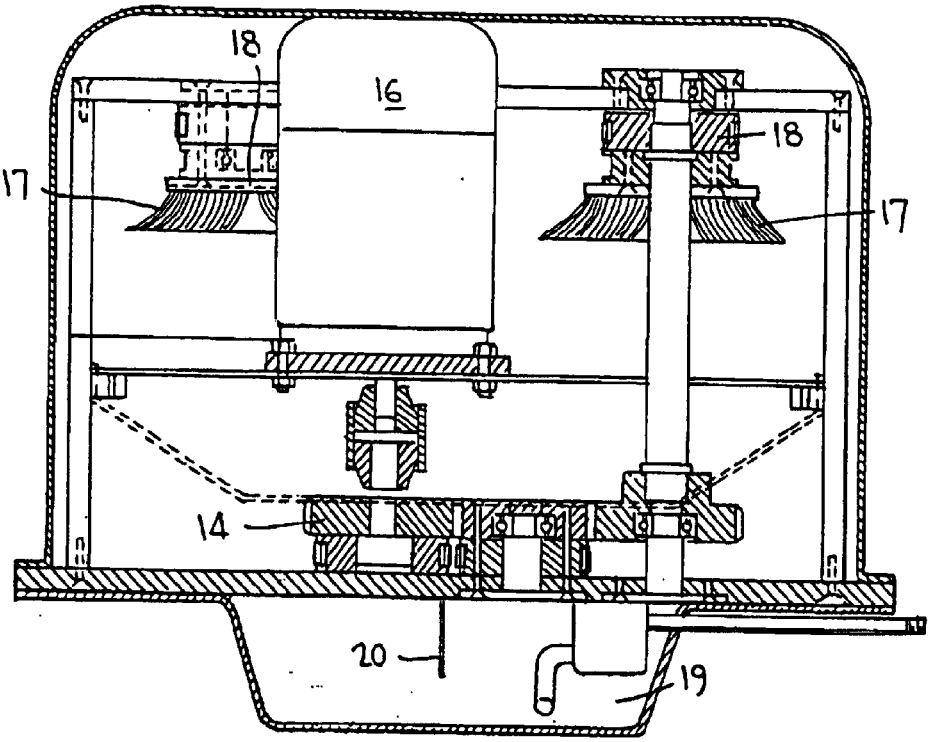
FIG. 6 shows a cross-section B—B.
Figure 7:
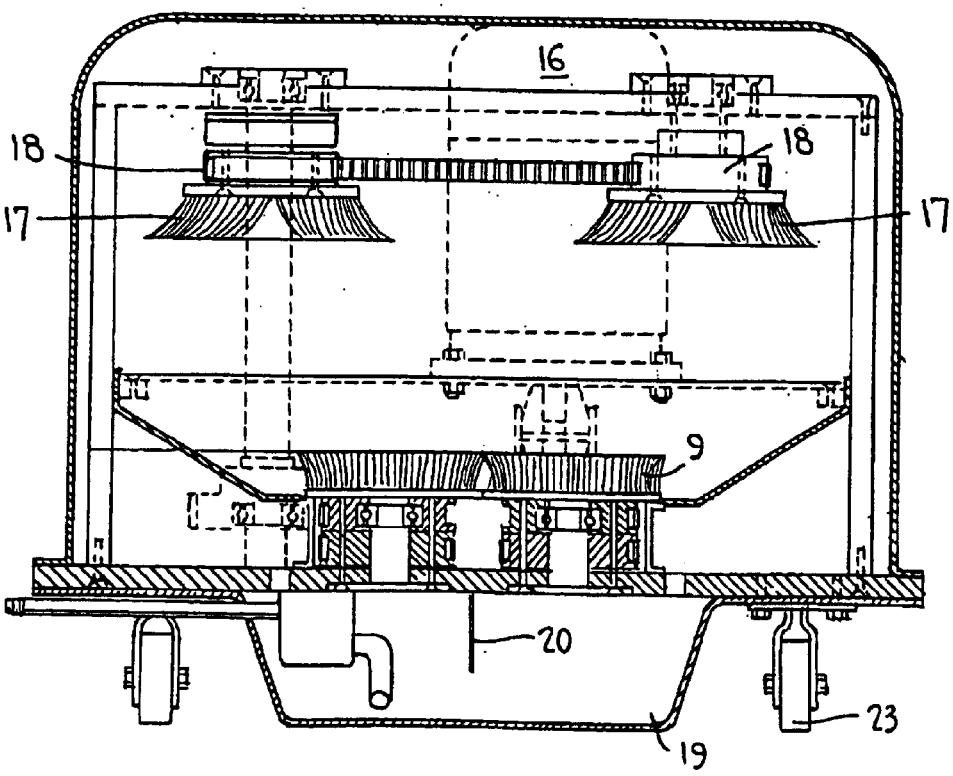
FIG. 7 shows a cross-section C—C.

Referring to the drawings, the shoe-brushing machine comprises a casing (1) made of a plastic material, such as ABS, PP, PET, or the like, particularly resistent and coated with a material for protecting it against wear.

On the top of the casing (1) there are the controls for operating the machine; the audible warning device (2), the "on" switch (3), the "on" light (4), the blocked-device light (5), the display (5), the switch for emptying the container (7), the emergency button (8). Internally, in the bottom section, there are 5 cup brushes (9), preferably of a diameter of 100 mm, made of nylon or other suitable and similar material. The brushes (9) are housed in the metal structure (10) inside which are the supports (11) with the relative ball bearings (12) and cogged couplings (13) for transmitting the movement from the electric motor (16) to the brushes, by means of the positive drive belt (14) engaging a cogged pulley (15). Thanks to the gear transmission the brushes (9) rotate specularly.

In the top section of the machine there are two brushes (17) integral with a metal base (18) which are rotated by the motor (16).

In the bottom part of the machine there is a case with the container (19) for collecting the snow, water, dirt, or whatever else is removed from the shoes by means of the brushes (9), or the jet of water or disinfectant. Inside the container (19) there are one or more float switches (20) capable of warning when the maximum level of water, dirt or the like has been reached.

In the front of the casing (1) there is an opening into which the shoe must be placed for cleaning and sanitization, if necessary.

In order to make it easy to move and transport, the preferred embodiment of the machine also features rear wheels (23) and a front handle (24).

Figure 8:
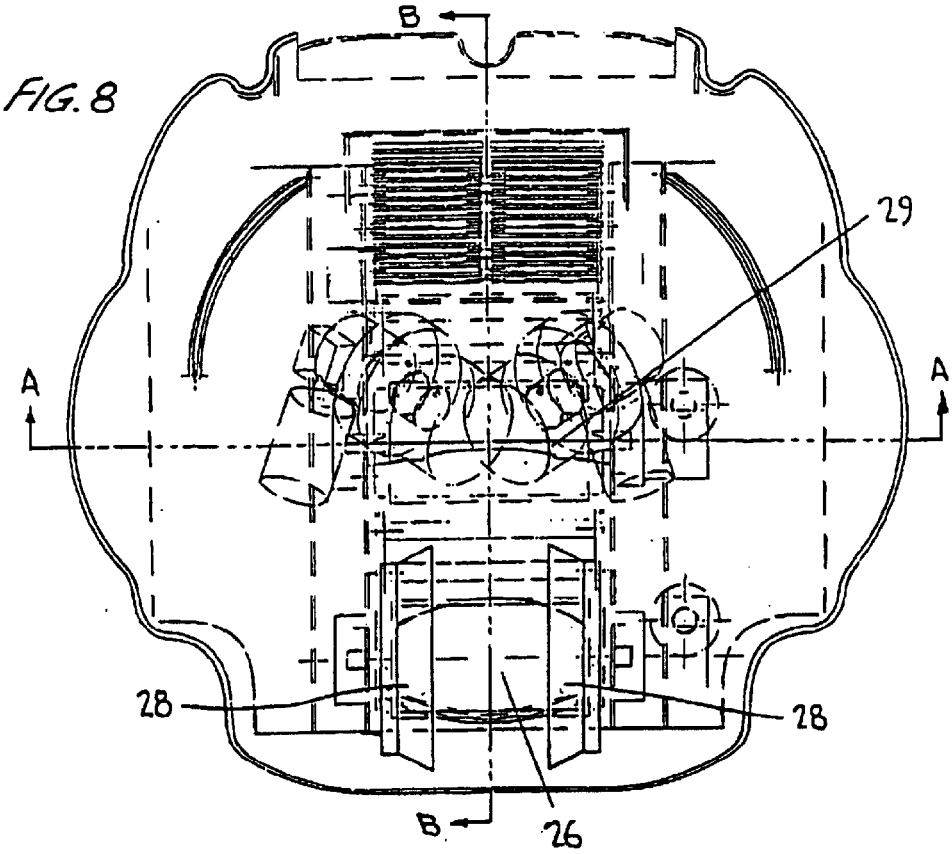
FIG. 8 shows a plan of the machine, where the brush at the front consists of a roller brush in the middle integral with two larger-diameter cup brushes at the sides.
Figure 9:
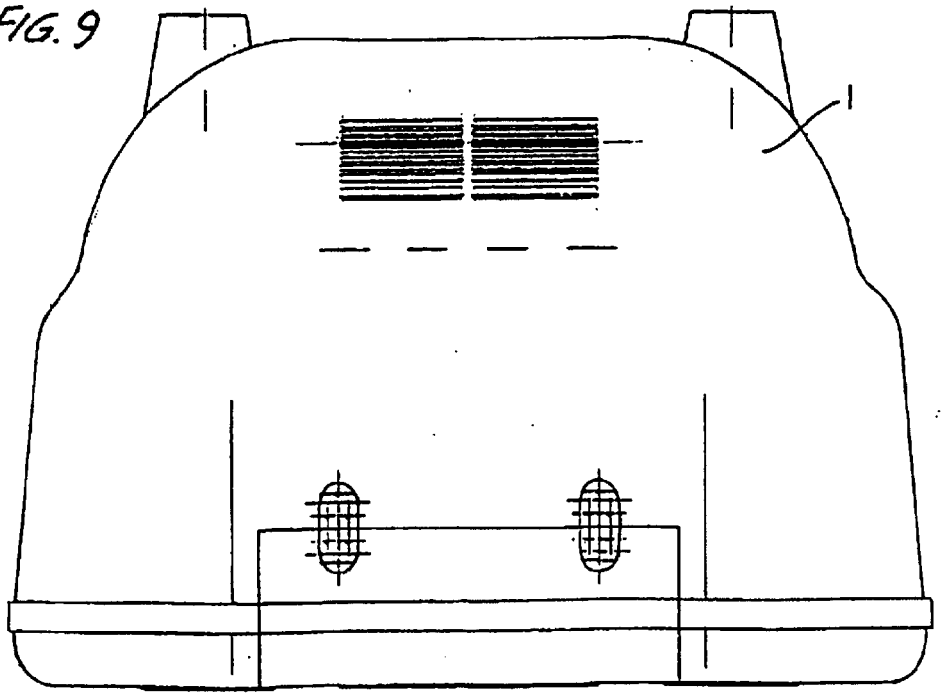
FIG. 9 shows a rear view of the machine.
Figure 10:
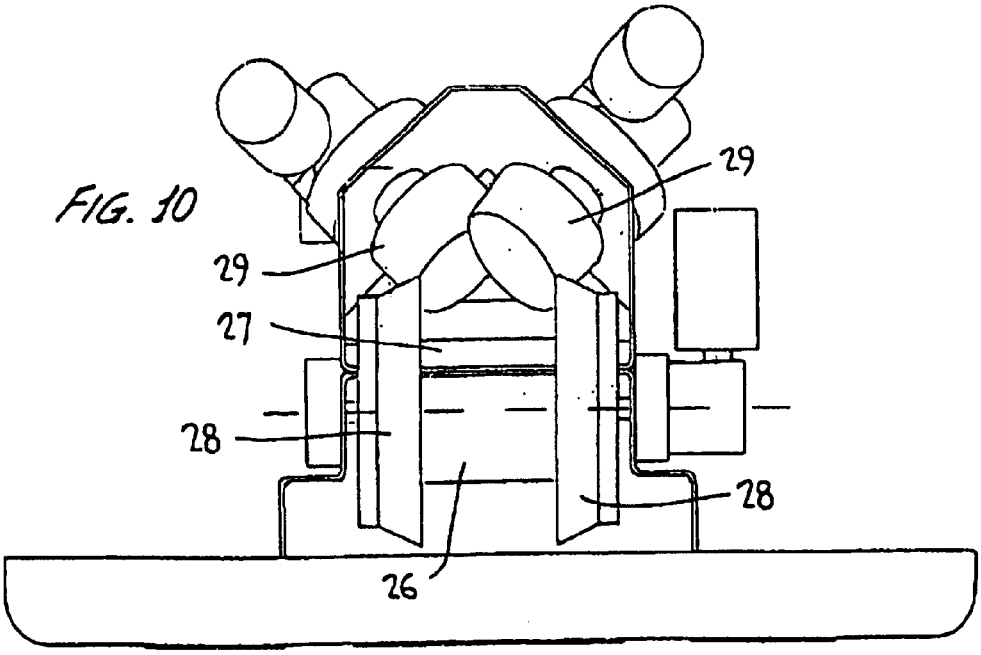
FIG. 10 shows a view of the machine with the brush referred to in FIG. 8 in the foreground and the upper brushes in the background.
Figure 11:
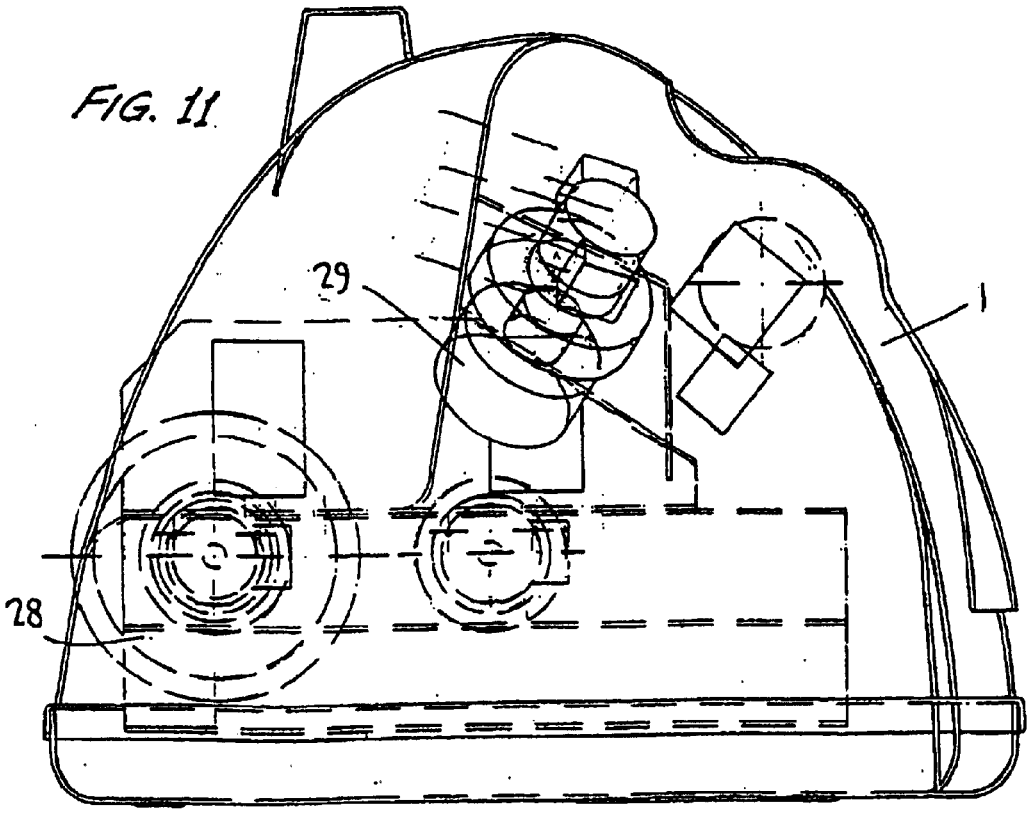
FIG. 11 shows a side view of the machine according to the FIGS. 8 to 10.

As may be seen in FIGS. 8, 10 and 11, this embodiment of the machine may also be provided with a roller brush (26) in the middle, to clean the sole of the shoe, and complete at the sides with two cup brushes (28) for cleaning the sides of the soles and the upper; at the top there are the brushes (29) for cleaning the upper.

The manner of operation of the machine is rather simple: first one must plug it in and switch it on.

The audible warning device then issues a series of pre-recorded messages guiding the user to the use of the machine or warning of the mistaken position of the shoe or of any failures; the messages are in the local language, but it is possible to change the language to suit the user.

For example, when the machine is still not working, the messages might be:

Please make sure your shoe-laces are tied before introducing your shoe; please introduce your shoe gently, ecc.; when the foot is introduced inside the opening (21) a photocell assesses the size of the shoe (whether it is small or large) and sends a message of confirmation to the PLC unit (25) and the cleaning cycle will then start after about 2 seconds, warning the user by means of the audible warning device of the start and finish of the operations.

When the user changes foot the cycle starts all over again. At the end of the cycle, after both shoes have been cleaned, there is a pause to discourage the same person from re-using the machine immediately after. The emergency button (8) allows the user to stop the machine immediately, in the case the laces get caught or in any other emergency.

As mentioned above, the principal aim of this machine is to clean the sole of shoes from snow, mud and the like, therefore it is of the utmost importance that the container should always be capable of collecting the dirt, etc. removed from the shoes; this is why the machine has been designed to automatically stop and signal the situation when the container (19) is full. The container can thus be emptied with known means, e.g. a pipe connected to the container. Obviously, if the container (19) is connected to a drain pipe the emptying can take place automatically.

The dirt is held by a replaceable filter and the larger particles of dirt by a net with a 1×1 mm mesh, for example, which can be removed and cleaned twice a week.

Cleaning the machine is easy because it is sufficient to remove the rubber shock absorber (22) designed to seal the two sections, unscrew two screws on the rear and just lift the top section to access the parts that needs cleaning.

Up to now, the preferred embodiment has been described. Obviously, however, there may be many embodiments of the machine according to the place where it is to be used, giving precedence to the particular aspect of cleaning the soles.

Another embodiment, for example, could be used at seaside resorts with a sand aspirator instead of the water jet; in this case the brushes and the brushing action could be softer.

There could also be a sanitizing embodiment, by means of which the sole is brushed and then sanitized with a 0.25% solution of chlorine, or other appropriate substance. The disinfectant could be released by means of a dispenser located near the lower brushes, radial injectors fed from a tank by an electronic pump controlled directly by the PLC unit; this embodiment could also be equipped with a pH-meter for monitoring the characteristics of the disinfectant, also controlled directly by the PLC unit; if the solution exceeds certain parameters the machine stops automatically and warns the user with a vocal message; this embodiment might be very useful in hospitals, chemical laboratories, pharmaceutical and food processing plants, in all those environments where maximum hygiene is a priority.

Besides the above-mentioned embodiments, roller brushes or differently shaped brushes may be used, instead of cup brushes, and the motor may also be replaced by electric, hydraulic, pneumatic or battery power. Furthermore, there may also be internal jets of (warm or cold) water and air to facilitate the removal of the impurities, to melt the snow or ice, and dry the shoe; a specific embodiment may also be developed for very small or childrens' shoes, or very large shoes, for special situations, and the machine may also be coin-operated or operated by means of a prepaid card or the like, or even a skipass, for example, in skiing resorts. The dirt container may be made as a disposable bag, to remove and throw away, if this is more convenient.

What is claimed is:

1. A shoe-cleaning machine for removing mud, snow and dirt from a shoe, comprising a casing with an opening for introducing the shoe; a frame inside in a bottom section of the casing having first pins integral therewith; first brushes positioned on the first pins for cleaning a sole of the shoe; second brushes in a top section of the casing positioned for cleaning an upper portion of the shoe; a frame in the top section containing second pins on which the second brushes are positioned; a motor for powering said machine in operation; gear wheels and positive drive belts for transmitting movement of the motor to the first brushes and second brushes; a container in the bottom section of the casing for collecting water and dirt removed from the shoe by the first brushes and second brushes; means by which the container can be emptied of collected water and dirt; means for discharging air including nozzles for distributing the air above or below the shoe; sensors positioned in relation to said casing for determining size of the shoe; electronic means for processing data received from the sensors; operating controls on said casing for setting and starting a cleaning cycle.

2. A shoe-cleaning machine as claimed in claim 1, wherein the operating controls comprise an audible warning device, an "on" switch, an "on" light, a blocked-machine light, a display, a switch for emptying the container and an emergency button.

3. A shoe-cleaning machine as claimed in claim 2, wherein the audible warning device plays messages instructing a user on how to use the machine or informing the user that the shoe has been improperly placed in the machine or that the machine is not working properly.

4. A shoe-cleaning machine as claimed in claim 1, wherein the first brushes are cup brushes, said cup brushes having a diameter of 100 mm, and being housed in a structure including supports with relative ball bearings and cogged couplings for transferring the movement of the motor to the first brushes by means of the positive drive belts which engage a cogged pulley; and a gear transmission which enables the first brushes to move specularly.

5. A shoe-cleaning machine as claimed in claim 1, wherein the second brushes are two cup brushes driven by a transmission of the motor.

6. A shoe-cleaning machine as claimed in claim 1, wherein inside the container for collecting water and dirt are present two or more float switches for signaling when the container is full.

7. A shoe-cleaning machine as claimed in claim 1, further comprising rear wheels and a handle attached to said casing.

8. A shoe-cleaning machine as claimed in claim 1, further comprising a photocell and PLC unit, wherein the photocell sends a command to the PLC unit when the shoe is introduced in said opening which starts the cleaning cycle and warns a user by an audible warning device of beginning and end of the cleaning cycle.

9. A shoe-cleaning machine as claimed in claim 8, wherein at the end of the cleaning cycle there is a pause.

10. A shoe-cleaning machine as claimed in claim 1, further comprising in the container a replaceable filter for holding dirt which falls into the container from the shoe.

11. A shoe-cleaning machine as claimed in claim 1, further comprising a sand aspirator.

12. A shoe-cleaning machine as claimed in claim 1, further comprising a sanitizing device with injectors for applying a disinfectant to the shoe.

13. A shoe-cleaning machine as claimed in claim 1, wherein the second brushes are roller brushes and the motor is electric, hydraulic, or pneumatic.

14. A shoe-cleaning machine as claimed in claim 1, wherein the nozzles distribute the air as jets of air.

15. A shoe-cleaning machine as claimed in claim 1, wherein the machine is coin operated or operated by a prepaid card.

16. A shoe-cleaning machine as claimed in claim 1, wherein a roller brush is positioned inside the casing in the front of the casing, in the middle of the casing, and along each side of the first brushes.

* * * * *